United States Patent [19]

Reed

[11] 4,068,738

[45] Jan. 17, 1978

[54] SCAFFOLDING

[76] Inventor: Ronald Reed, 6, Cutherbert's Terrace, Hexham-on-Tyne, Northumberland, England

[21] Appl. No.: 632,574

[22] Filed: Nov. 17, 1975

[30] Foreign Application Priority Data

Nov. 18, 1974 United Kingdom ..... 49827/74

[51] Int. Cl.[2] ..... E04G 3/10

[52] U.S. Cl. ..... 182/128; 182/150

[58] Field of Search ..... 182/128, 82, 229, 150, 182/199, 36, 37, 115; 59/86, 85, 93

[56] References Cited

U.S. PATENT DOCUMENTS

| | | | |
|---|---|---|---|
| 295,592 | 3/1884 | Suber | 182/229 |
| 763,274 | 6/1904 | Foster | 182/130 |
| 1,484,480 | 2/1924 | Donaggio | 182/150 |
| 1,506,114 | 8/1924 | Donaggio | 182/150 |
| 1,750,269 | 3/1930 | Johnston | 182/130 |
| 3,454,131 | 7/1969 | Johnson | 182/115 |
| 3,454,133 | 7/1969 | Gregord | 182/128 |
| 3,462,945 | 8/1969 | Barber | 59/86 |
| 3,747,706 | 7/1973 | Paine | 182/113 |

FOREIGN PATENT DOCUMENTS

| | | | |
|---|---|---|---|
| 832,903 | 7/1938 | France | 182/150 |

*Primary Examiner*—Reinaldo P. Machado
*Attorney, Agent, or Firm*—Oblon, Fisher, Spivak, McClelland & Maier

[57] ABSTRACT

This invention is staging or scaffolding for use within a tank for example a storage tank in chemical plant or in a marine oil tanker, and an assembly of staging comprises a number of platforms each coupled to at least three flexible chains adapted for connection at top and bottom to a side wall or the roof or floor of the tank with the chains extending vertically between the top and bottom fixing points and the platforms extending horizontally and spaced vertically from one another. The assembly can be collapsed and lowered through a hatch in the root of the tank or can be built up within the tank and the connection at the top may be to a releaseable shackle which remains engaged so long as the chains are supporting substantial weight, but which automatically release when weight is removed so that removal of the staging after it is no longer required can be done quite safely without an operator standing on the staging.

17 Claims, 9 Drawing Figures

SCAFFOLDING

BACKGROUND OF THE INVENTION

This invention relates to scaffolding or staging for erecting within the hull of a ship. It is related to the invention, the subject of British Pat. No. 1340487 which is for staging for securing on the outside of a hull — or even a building for example an oil storage tank, chemical plant, or off-shore oil rig, — to enable work to be done on it. This specification will refer to 'tanks' to embrace all such structures. The staging can be quickly erected, and removed if it is not to be permanent or semi-permanent structure.

For use within a hull difficulties arise due to the small opening usually available for access to the tanks and due to the need to transfer the staging from tank to tank longitudinally through transverse bulkheads and in fixing the staging at or near the top of a tank. The present invention has for one object to overcome some of these difficulties.

SUMMARY OF THE INVENTION

Accordingly the invention has several aspects, as set out below, either used alone or in any combination.

The staging may comprise a number of platforms coupled by chains or cables (hereinafter called chains) to be capable of being suspended in respective vertically-spaced, horizontal planes, by each being secured at a different distance along the chains which run with a substantial vertical component, the collapsed stack of platforms and chains preferably being capable of being lowered through a hatch 1 meter wide with the platforms disposed vertically. At the inner edge of each platform there is preferably an inwardly-extending horizontal transom which can be projected sufficiently to bear against the adjacent wall and give the assembly stability.

The platform could be fed into the tank individually and assembled with the chains inside.

In general there will be means for attaching the chains at top and bottom in the tank so that they cannot swing horizontally.

There may be a beam or cable extending horizontally from a tank on one side of a bulkhead to a tank on the other side and adapted to convey the staging assembly between the tanks.

For securing the staging assembly at the top of a tank in which it has been put, there may be access holes in the deck or roof above through which the assemblies can be winched up, or lifted by a crane, and there may be prefixed lugs secured to that deck for holding the top of a winched-up assembly. For securing a number of assemblies side by side, there may be a horizontal beam or cable secured at two spaced points and adapted to hold the tops of all the assemblies.

For making the disconnection of such assemblies after use a safe operation, the tops of the assemblies may be held by shackles having spring-loaded pins which are automatically held engaged as long as they are carrying weight, but which automatically release when not holding weight.

Thus when the assembly is lifted into position it can easily be suspended from the released shackles; after use the weight of the assembly can be taken by a crane so that the shackles then automatically release and the assembly can be lowered by the crane.

According to an aspect of the invention a coupling comprises a shackle and a bolt which is spring-loaded towards the withdrawn position from a position closing the shackle, but which can be held closing the shackle against the loading of the spring by friction due to load between the shackle and the bolt when the coupling is carrying a weight. There may be a nut or other positive engagement means for preventing release of the bolt as a safety measure even if the weight is removed from the coupling.

In a preferred embodiment the shackle has a pair of arms each bored for the bolt, and a housing fast with one arm and containing the spring, which is a helical compression spring, arranged to be compressed when the bolt extends through both arms and to be capable of extending sufficiently to allow the bolt to be withdrawn from the gap between the arms.

The invention includes a method of supporting staging by engaging chains or other suspensions for the staging from one or more couplings each as claimed in any of the preceding claims, the weight of the staging being sufficient to prevent withdrawal of the bolts, and a method of releasing the staging in which the positive engagement means are released by a man on the staging while the staging is engaged with a crane, but the weight of the staging is only taken by the crane after the man has left the staging.

One aspect of the invention is an arrangement of the staging assembly according to which one platform has a ladder which is normally stowed folded parallel with the platform but is capable of being erected or dropped on to the adjacent platform to provide quick access between platforms.

BRIEF DESCRIPTION OF THE DRAWINGS

The invention may be carried into practice in various ways and certain embodiments will now be described by way of example with reference to the accompanying drawings, in which.

DETAILED DESCRIPTION OF THE PREFERRED EMBODIMENT

Figure 1:
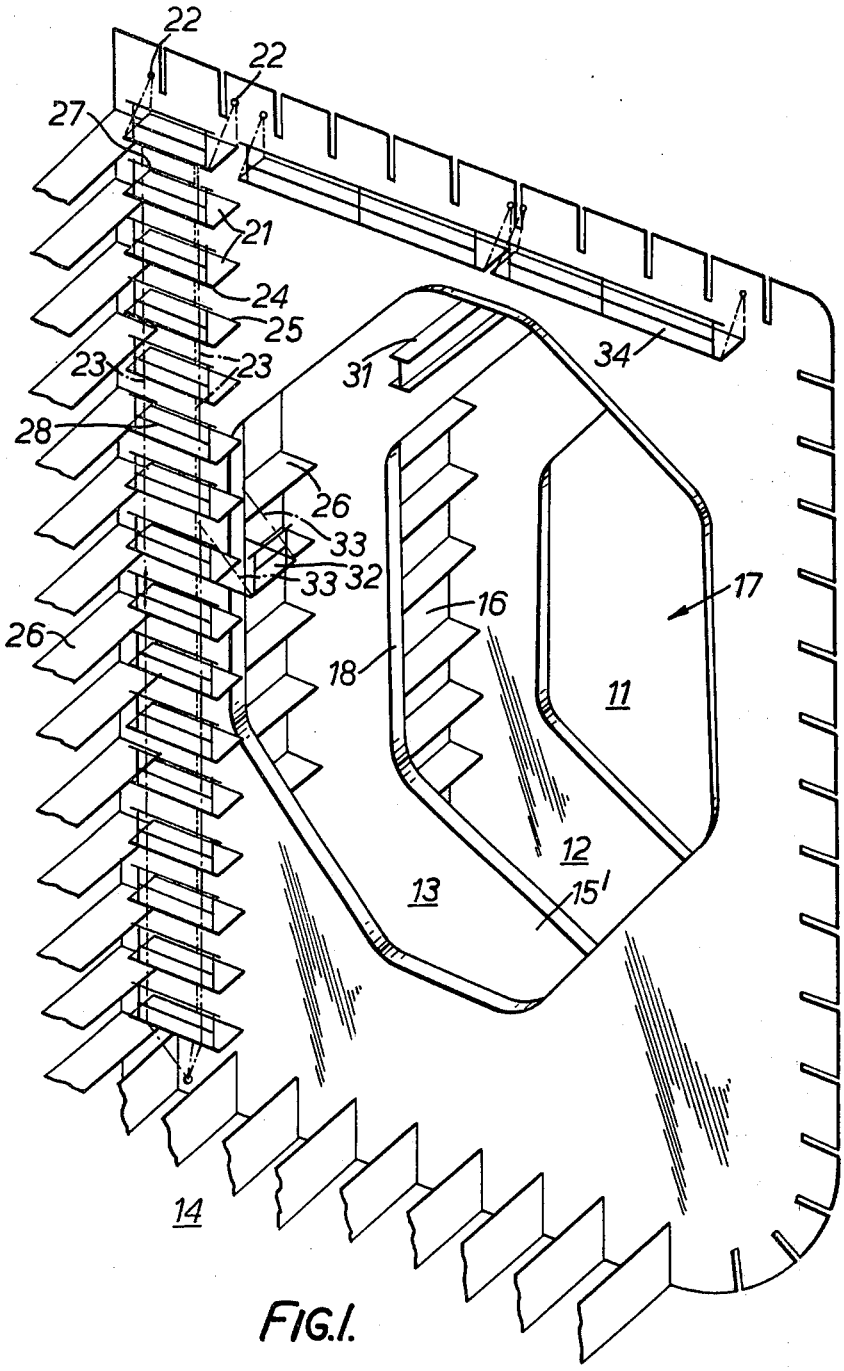
FIG. 1 is a general layout drawing showing how staging according to the invention can be used in the hull of a ship or other tank.

As shown in FIG. 1 the interior of a ship's hull typically consists of longitudinally-spaced tanks 11, 12, 13, 14 spaced apart by transverse bulkheads 15 welded to the sides 16 of the hull, the transverse bulkheads having restricted openings such as 17 for providing access from one tank to the next which have, around their edges, facing plates 18 extending perpendicular to the bulkhead surface at each tank side.

If the staging assembly is to be introduced into a tank after the ship has been built so that the deck is closed, a problem arises in getting the assembly through whatever narrow hatch opening is available and also lifting the assembly from tank to tank.

A typical staging assembly is shown at the left hand side of the figure and consists of a series of platforms 21 of which the top platform is suspended against a bulkhead 15 by chains at fastening points 22 whereas the other platforms are connected to three vertically extending chains 23 each of which is connected at one point to each platform either at one of the outer corners 24 or at the centre of the rear edge 25. The lower ends of the chains are anchored by means shown in FIG. 7. The arrangement of three chains enables the assembly to be fixed in a position in which it does not interfere with plates such as 26 forming part of the hull construction because there is no chain at the rear corner such as 27. Each platform has a vertical outer safety rail 28, which may be telescoping, or may be merely a flexible chain attached to the outer suspension chains.

There is no difficulty in fixing the assembly in position if the deck or roof of the tank has not been fitted as is the case in FIG. 1.

In order to get a staging assembly into a tank with a deck, in the first place it is arranged that platforms are long and narrow, typically 0.75 – 1.0 meters wide and 2 – 6 meters long so that they can be fed through a hatch in the deck on edge while the platforms extend in a vertical plane. It may be possible to lower them into the hold one by one while connected together by loose chains or it may be possible to lower them while extending side by side with all their planes vertical. A crane or tripod-mounted winch perhaps three meters high on the deck of the ship or a crane on the dock can be used for lowering the assembly in that way. In order to give the assembly rigidity it is important that on the rear edge of each platform 21 is a rearwardly extending pair of transoms 30 (FIG. 3) of adjustable length which can be extended against the wall where the assembly is to be supported. Also vertically telescoping transoms 20 (FIG. 4) can be extended upwardly from the top platform to the underside of the deck.

To get over the difficulty of passing the assembly from one tank 14 to another tank 13 a rolled steel joist 31 can be mounted either as a temporary, or preferably as a permanent, fixture in the top of the hull extending from tank to tank. Then when the assembly has been fed into the tank 14 for example it can be suspended from a carriage running along the joist 31 so that it can be transported through openings 17 into the adjacent tank 13 or 12.

An auxiliary platform 32 is shown for providing a connecting platform between the edges of platforms 21 in two different assemblies one on either side of the bulkhead 15. The outer corners of that auxiliary platform 32 are supported from the main chains 23 by auxiliary chains 33.

Further platforms may be simply supported along the top of a bulkhead 15 as indicated at 34.

Once the assembly has been fed along the joist 31 it can be erected in the next tank possibly by means of a crane acting through transversely cut holes in the deck above the tank and suspended from lugs or shackles permanently fixed to the inside of the tank. Instead of the joist shown at 31 it is possible to have a temporary steel cable extending transversely from tank to tank and carrying a hook by means of which the assembly can be passed through the bulkheads.

Figure 2:
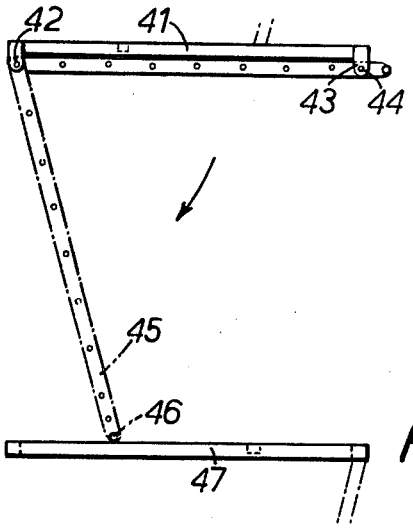
FIG. 2 is a drawing showing some details of a part of a staging assembly incorporating a ladder between stages.

FIG. 2 shows a preferred arrangement of a staging assembly according to which a higher platform 41 has pivotally mounted to it at 42 a ladder which can be stowed horizontally below the platform 41 by a clip 43; which when a pin 44 is released from the clip 43 can be swung downwards to the position shown at 45 in which it is inclined slightly to the vertical and its lower end 46 rests on the lower platform 47, access to it is through a square hatchway 40 in the upper platform 41. Then when the chains 23 are slack a pair of platforms 41 and 47 can be compactly stacked with the ladder 45 between them.

Each horizontal platform proper may have a vertical safety rail having lower legs which then pivot on longitudinal pins passing through lugs welded to the platform. At the front corners and at the centre of the rear edge are welded attachment points for the chains. Also at the corners of the platform are upstanding pins to assist in stacking the platforms together when the assembly is collapsed and the rails are removed, or are telescoped and pivoted over the platforms.

Figure 3:
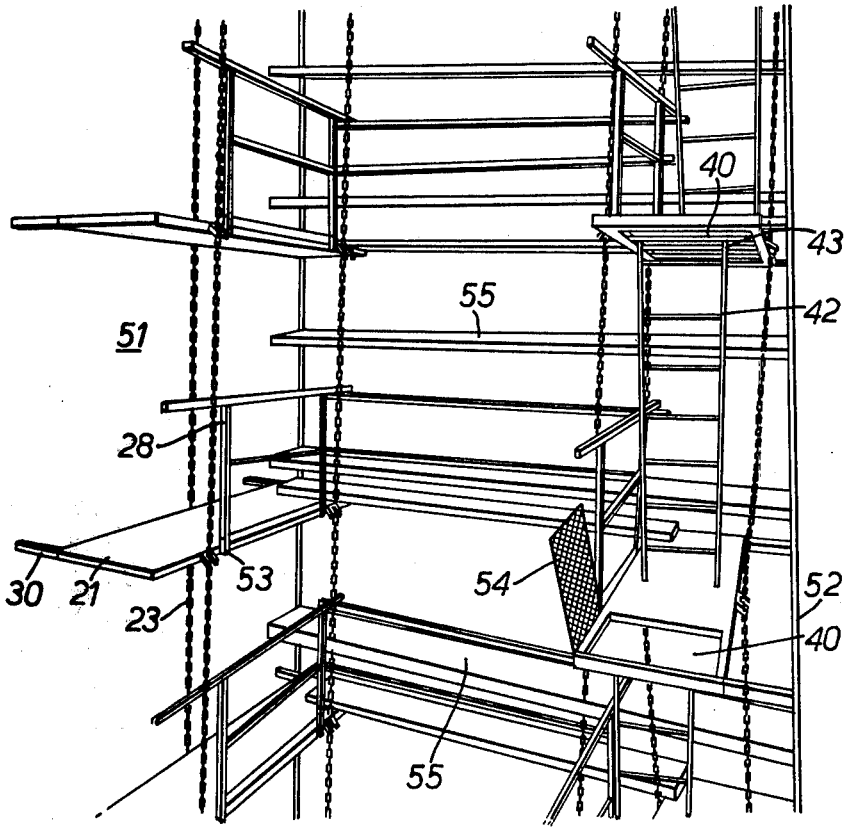
FIG. 3 is a detail showing two staging assemblies in use.

FIG. 3 shows two scaffolding assemblies in use in a three sided tank which may be a wing tank in a ship or may be a tank in a chemical plant or in some other building.

A scaffolding assembly consisting of an array of platforms 21 suspended on their three chains 23 is suspended down each of the two opposite sides 51 and 52 of the tank by couplings at the roof and at the floor as will be described later. Each platform has its internal transoms 30 set to butt against the wall 51 or 52 to give the assembly rigidity, and it can be seen that each platform also has a safety rail 28 which can by pivoted over to lie flat above the platform about pivots 53 and if necessary can be telescoped somewhat, so be capable of such stacking without protruding beyond the sides of the platform.

The assembly shown at the right in FIG. 3 is of the kind as shown in FIG. 2 in which each platform has a ladder 42 pivotally mounted at the top at 43 so as to extend downwards to the platform below it, and access to the ladder can be had through a hatch indicated generally at 40 with a removable pivotally mounted grid 54.

Additional platforms 55 can be mounted between the corresponding ends of platforms 21 on the two assemblies so that complete access can be given to the internal walls of the three sided tank.

Figure 4:
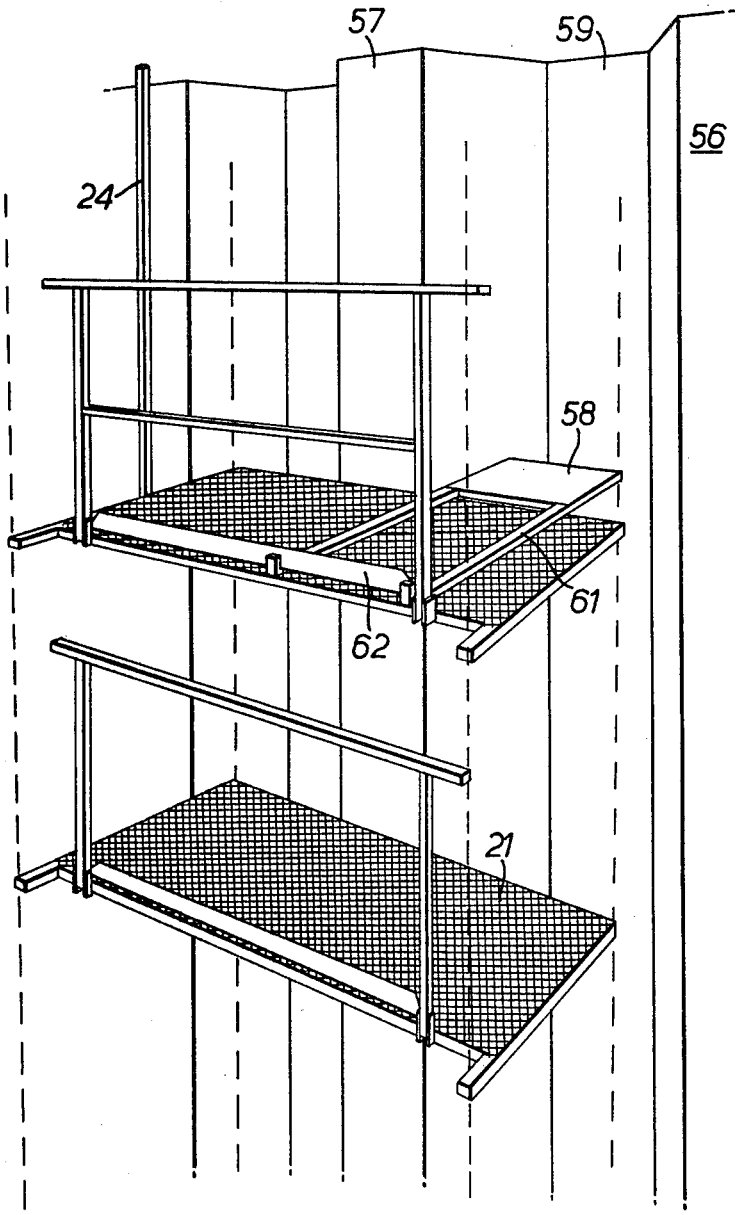
FIG. 4 shows two platforms of an assembly in use with a corrugated bulkhead.

FIG. 4 shows a staging assembly in use against a vertical bulk head 56 which is of corrugated form and it will be seen that whereas the inner edges of the platforms 21, butt against the internally protruding parts 57 of the bulk head, the platforms also have inwardly projecting extensions 58 entering into the recesses 59 in the bulk head. The extension platforms 58 are mounted on beams 61 which hook under a kick board 62 at the outer edge of the main platform. In other respects the assembly is similar to those already described although the vertical adjustable transom 20 is shown in that figure.

Figure 5:
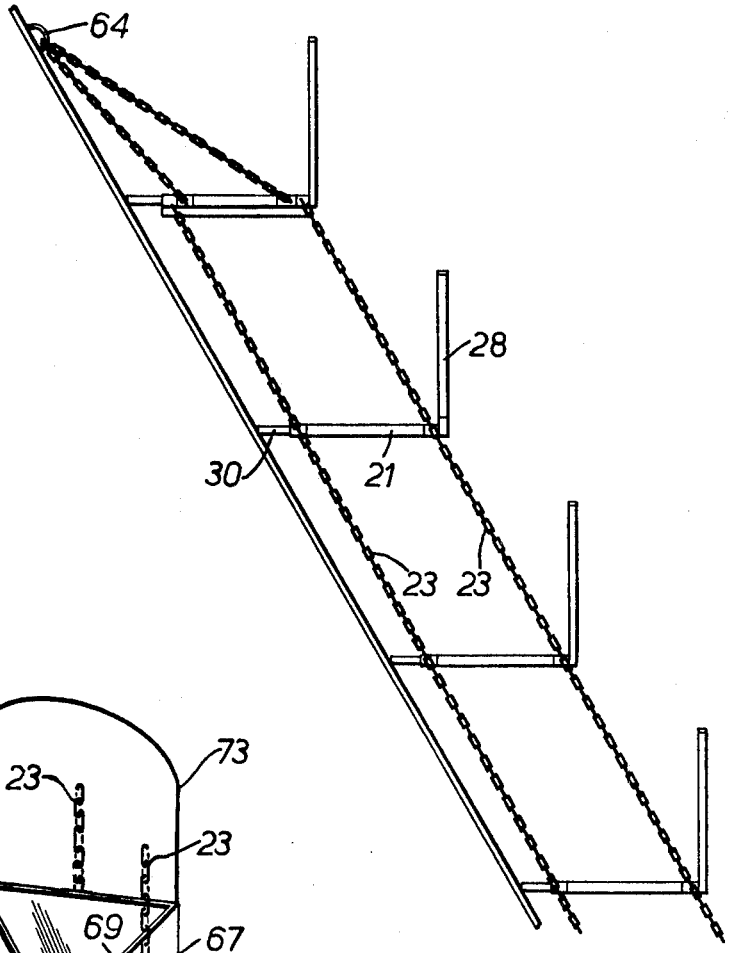
FIGS. 5 and 6 are sketches showing how an assembly can be more respectively in a bow section and under a hopper head.

FIG. 5 shows how a staging assembly can be fitted on the upper surface of a bowl section of a ship's hull with the chains at the top coupled to a lug 64 bolted to the bowl and the three chains extending downwardly as shown at 23, parallel with each other and with the line of the bowl section. The platforms 21 are shown with their transoms 30 projected inwardly against the bowl wall and with their hand rails 28 erected.

Figure 6:
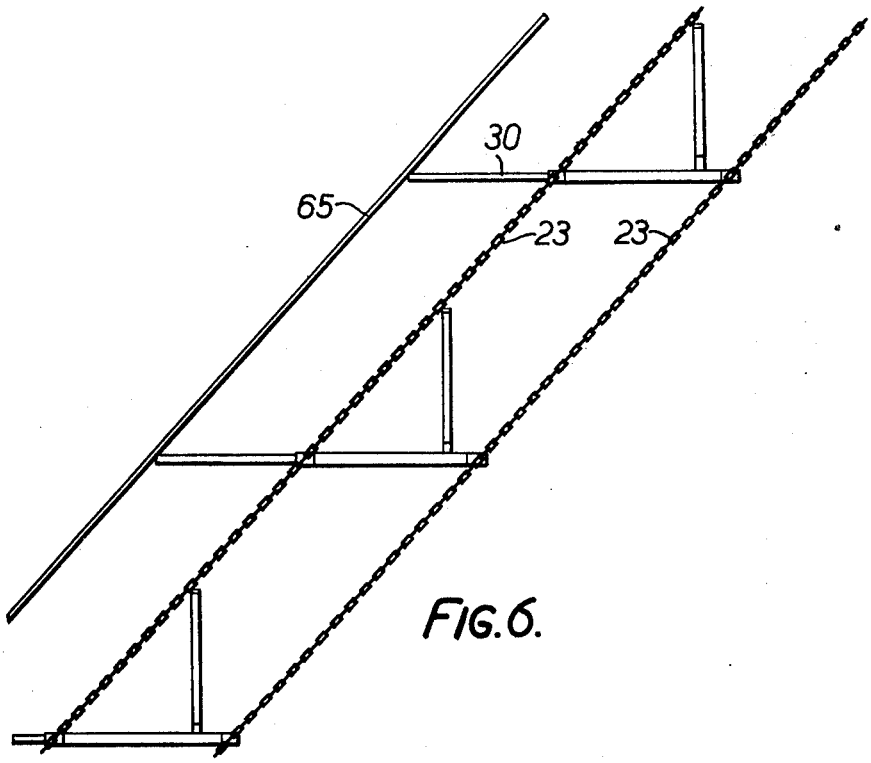

FIG. 6 shows how the staging assembly can be equally easily mounted on the underside of a hopper head 65, again with the chains 23 extending parallel with the hopper head and with the transoms 30 projected inwardly against it.

Figure 7:
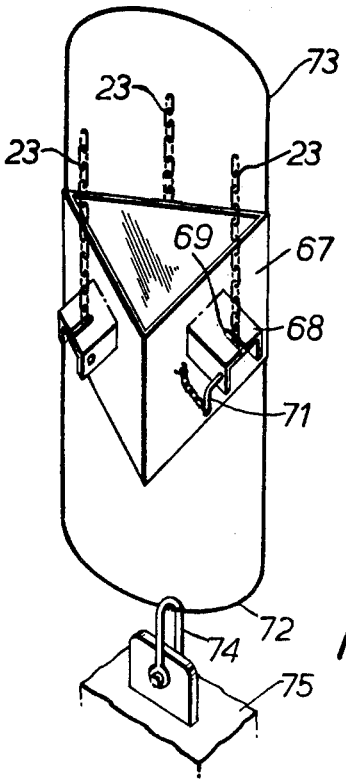
FIG. 7 is a sketch of a claw for clamping the three chains at the lower end of an assembly.

FIG. 7 is a sketch of a keel claw for clamping the lower ends of the three chains 23 of one staging assembly. The claw comprises three steel plates 67 each in a vertical plane forming a triangle in plan view and each having welded to its outer face a depending plate 68 having a downwardly facing slot 69 into which the lower end of one of the chains 23 can be inserted and hooked by a bolt at the lower end of the chain. Tension in the chain tends to hold it in the upper end of the slot but for safety a drop nose pin 71 is inserted through aligned holes inside pieces of the plate to give positive prevention against release.

The corners of the triangle of the plates have welded to them lower and upper steel hoops 72 and 73 the lower of which engages a lug 74 welded to the bottom of the hull at 75 and the upper of which is connected to a tensioning chain. Connection of the chains to the claw is very simple, and so is release when tension in the chains is released.

Figure 8:
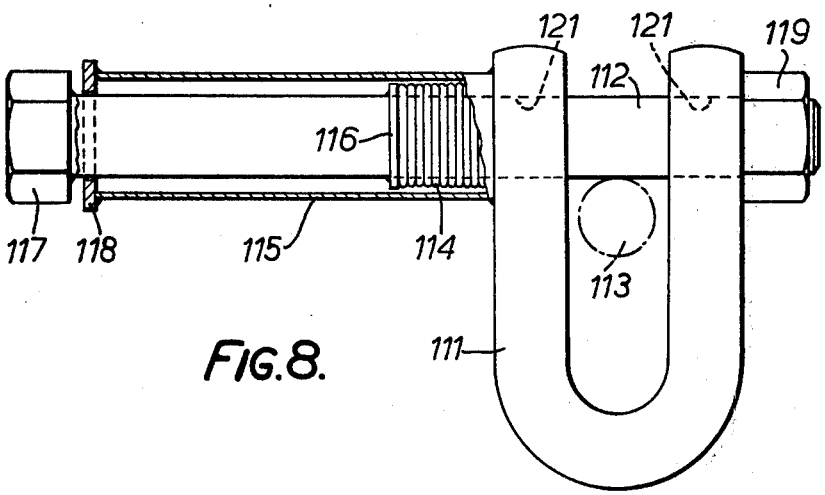
FIG. 8 is an elevation, partly in section, of coupling for suspending the upper end of a chain.

The coupling for the upper end of a chain shown in FIG. 8 comprises a U-shaped shackle 111 and a bolt 112 for closing the mouth of the U after a chain link 113 has been positioned within the U arms to prevent removal of the link. The bolt is normally biased away from the U by a compression spring 114 within a cylindrical housing 115 welded to one arm of the U, the spring acting between that arm of the U and a flange 116 welded on the bolt within the housing 115. The bolt head 117 is operatively associated with a washer 118 enclosing the housing.

In the example being described a force of 25 pounds is needed to compress the spring sufficiently to push the free end of the bolt through the opposite arm of the U and to screw a nut 119 on the threaded end to hold the coupling positively closed as shown in the drawing. The nut 119 is conveniently retained on a chain from the shackle when not in use on the bolt.

If the chain 113 is supporting a substantial weight from the shackle, the frictional force between the bolt 112 and the bores 121 in the U arms will prevent the bolt from being withdrawn by the spring 114 even if the nut 119 has been removed. If there is no weight or only a small weight supported by the shackle, the spring will withdraw the bolt automatically.

When staging is to be suspended from an internal wall or the underside of the deck of a ship as described, the staging is lifted into position by a crane, and it is safe for a man to stand on the staging as it is lifted to guide the staging chains into a set of the couplings just described and push in the bolts 112 and fit the nuts 119. The staging is then secure, the crane can release the staging leaving it on the couplings, and the man can climb down the staging.

If it were not for the automatic release due to the springs 114, when the staging was to be released from the couplings, it would not be safe to follow the reverse procedure. Thus if the man climbed up the staging and engaged the staging on the crane hook, and released the nuts 119, and withdrew the bolts 112, there would be a danger of a sudden movement as the bolts were released and the weight of the staging was taken by the crane.

The automatically-released couplings enable that danger to be avoided.

The man climbs up the staging and engages the crane with the chains, but the crane does not take the weight of the staging. The man releases the nuts 119, but the bolts are not withdrawn because the weight of the staging is still held on the shackles. The man climbs down, and then the crane is wound in to take the weight of the staging; as it does so, the friction between the bolts and their bores is reduced and the springs automatically withdraw the bolts. Even if there is a sudden movement of the staging as the weight is transferred from the couplings to the crane, there is no danger because the man has already descended.

The example described has a spring loading of 25 pounds for supporting a weight of 5 tons, but the characteristics could be scaled up or down in accordance with the weight to be carried.

An alternative to the nut 119, is a wedge engaged in a split end of the bolt 112.

Figure 9:
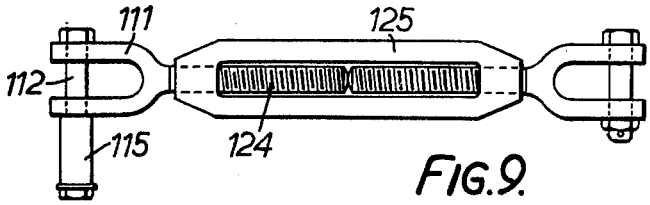
FIG. 9 is a turnbuckle arrangement for suspending two chains.

In another application as shown in FIG. 9 a pair of shackles is each formed on a threaded shaft 124 entering into opposite ends of a sleeve 125 to form a turn-buckle or rigging nut. Each shackle is closed by a bolt 112 with an automatic release as described with reference to FIG. 8, so that an operation of the turn-buckle to release load on cables on the bolts, the couplings will release automatically.

I claim:

1. Staging erected within a tank comprising:

a collapsible assembly of platforms fixedly secured at points spaced within the plane of each platform to three chains disposed within a three-point, triangular arrangement such that said platforms are suspended, in respective vertically-spaced horizontal planes, from said chains at a different distance, along said chains, which includes a substantial vertical component, said assembly of platforms and chains being secured at the top and bottom thereof to an inner side wall of said tank or to the neighboring surface of the top or bottom of said tank.

2. Staging as claimed in claim 1 in which the collapsed stack of platforms and chains is capable of being lowered through a hatch 1 meter wide with the platforms being disposed vertically.

3. Staging as claimed in claim 1 in which some of the platforms have horizontal transoms extended against the wall of the tank.

4. Staging as claimed in claim 1 in which the top platform has a vertical transom extending against the underside of the roof of the tank.

5. Staging as claimed in claim 1 in which each platform has a collapsible hand rail.

6. Staging as claimed in claim 1 in which the platforms have ladders pivotally mounted to them for providing access between platforms of different vertical height.

7. Staging as claimed in claim 6 including hatch-ways in the platforms for giving access to the ladders.

8. Staging as claimed in claim 1 in which the chains are secured at the top to shackles which are biased to release the chains automatically when the weight of the staging is removed from the shackles.

9. Staging as claimed in claim 1 in which the chains are secured at the bottom to a plate having a downwardly-facing notch for engaging each chain.

10. Two sets of staging each as claimed in claim 1 in combination with platforms extending between the platforms of the two sets of staging by resting at the ends on platforms in the staging.

11. Staging as claimed in claim 1 erected within a structure having two tanks separated by a bulk head and having a beam or cable extending from one tank to the other through a hole in the bulk head and adapted for movement of the staging from one tank to the other along the beam or cable.

12. A method of erecting staging within a tank comprising the steps of:

introducing into said tank a stack of platforms, supported one above another as a result of each platform being secured at points spaced within the plane of the platform to three chains disposed in a three-point triangular arrangement, as a collapsed assembly; and subsequently securing said chains at the top and bottom portions thereof to an inner side wall of said tank or to the neighboring surfaces of the top or bottom portion of said tank, such that said chains extend parallel to each other, with a substantial vertical component, with the platforms being in vertically spaced horizontal parallel planes.

13. A method as claimed in claim 12 further comprising:

extending a transom horizontally from each platform against the wall of the tank.

14. A method as claimed in claim 12 further comprising:

extending a transom vertically from the uppermost platform against the underside of the roof of the tank.

15. A method as claimed in claim 12 in which before being assembled within the tank the platforms and chains are lowered into the tank vertically through a hatch in the roof of the tank.

16. A method of releasing staging erected by a method as claimed in claim 12 in which the chains are secured at the top by a shackle which is automatically released when load is taken from it, the shackle also having positive engagement means, the method being one in which the positive engagement means is released by a man on the staging while the staging is engaged by a crane but the weight of the staging is only taken by the crane so as to remove the load from the shackle after the man has left the staging.

17. A method as claimed in claim 12 in which staging is transferred frome one tank to another through an aperture in a bulk head in the tanks by being moved along a beam or cable extending through the aperture.

* * * * *